United States Patent [19]

Thomas

[11] 3,937,930

[45] Feb. 10, 1976

[54] ROTARY SLIDE RULE FOR TOPOGRAPHIC CALCULATIONS

[76] Inventor: Frank J. Thomas, Box 5262 Hicrest Station, Topeka, Kans. 66605

[22] Filed: Dec. 17, 1973

[21] Appl. No.: 425,562

[52] U.S. Cl. ..... 235/78 R; 235/88 R
[51] Int. Cl.[2] ..... G06C 27/00; G06C 3/00
[58] Field of Search..... 235/88, 83, 70 A, 78 R, 235/122, 116

[56] References Cited

UNITED STATES PATENTS

| | | | |
|---|---|---|---|
| 1,262,635 | 4/1918 | Cady | 235/88 |
| 1,461,449 | 7/1923 | Mathieson | 235/83 |
| 2,477,556 | 7/1949 | Shaw | 235/83 |
| 3,369,745 | 2/1968 | Merz | 235/88 |
| 3,432,927 | 3/1969 | Springer | 235/83 |
| 3,745,658 | 7/1973 | Raneses | 235/88 |
| 3,747,846 | 7/1973 | Long | 235/78 |

*Primary Examiner*—Stephen J. Tomsky
*Attorney, Agent, or Firm*—D. A. N. Chase

[57] ABSTRACT

A rotary calculator is disclosed for use in site grading applications and other surveying operations involving the conversion of rod readings to datum or sea level elevations, the determination of depths of cut or fill required for finish grading, and the calculation of material quantities to be moved. The baseplate of the calculator is provided with an annular rod reading scale, and a circular conversion unit is concentrically mounted on the baseplate within the rod reading scale. The unit employs three annular elevation scales covering the units and tens digits, the hundreds digit, and the thousands digit of elevation respectively, and three independently rotatable, coaxial discs align the elevation scales in a manner to convert rod readings radially aligned with the units and tens scale into corresponding elevations relative to a predetermined reference elevation, such as mean sea level. A top disc member overlies the conversion unit and is provided with an annular depth scale graduated to indicate depth of cut and depth of fill, and with material quantity information arranged in concentric circular arrays radially aligned with corresponding graduations of the depth scale. A pointer is rotatable about the common axis of the assembly and has a radial hairline used in visually aligning the scale readings.

11 Claims, 7 Drawing Figures

ROTARY SLIDE RULE FOR TOPOGRAPHIC CALCULATIONS

This invention relates to an instrument of the rotary slide rule type for performing special calculations required in site surveying and grading.

In surveying a site prior to the construction of a building complex, roadway, or other improvement, field rod readings are taken in the usual manner to determine the existing grades which will be represented by contour lines on a topographic site drawing. This involves conversion of the rod readings to datum or sea level elevations so that the drawing showing existing grades at the desired elevation intervals may be prepared. The site plan is finalized by the addition of finish grades and gridding as appropriate. Additional rod readings at the grid intersections may then be required for accuracy. Ultimately, the depths of cuts and fills must be calculated together with the material quantities resulting from the cuts and fills, so that the total quantity to be moved to or from the site will be known and in order that finish grades may be adjusted to balance excavation and fill as much as possible.

After rough grading, the fine finish grade is commonly indicated in the field by "blue top" stakes set at the grid intersections. Here again, the correspondence between rod readings and actual elevations must be determined. It may be appreciated, therefore, that the entire operation briefly discussed above involves a multitude of calculations which are oftentimes confusing even to the experienced engineer. Although computations by digital computer are widely used to save time and eliminate human error, the expense of computer time and programming can normally only be justified on large projects such as the building of highways. Thus, for small and medium sized jobs such as the preparation of a shopping center site, the engineer has heretofore relied largely on hand calculations assisted by conventional desk calculators and the like.

It is, therefore, the primary object of the present invention to provide a relatively inexpensive instrument that may be utilized in the field and in the office to rapidly perform the essential calculations associated with site surveying and grading, wherein the opportunity for confusion and human error is significantly reduced.

Another important object of the invention is to provide an instrument as aforesaid in the nature of a rotary slide rule capable of directly converting rod readings to datum or sea level elevations, and vice versa.

Still another important object of the invention is to provide a rotary slide rule instrument which is capable of calculating depths of cut and fill from existing and finish grade information, and which directly indicates material quantities for specific areas of ground.

Furthermore, it is an important object of this invention to provide an instrument as aforesaid which combines rod reading conversion and cut-and-fill calculation in order to eliminate intermediate calculations and provide direct determination of cut or fill depths from rod readings.

Figure 1:
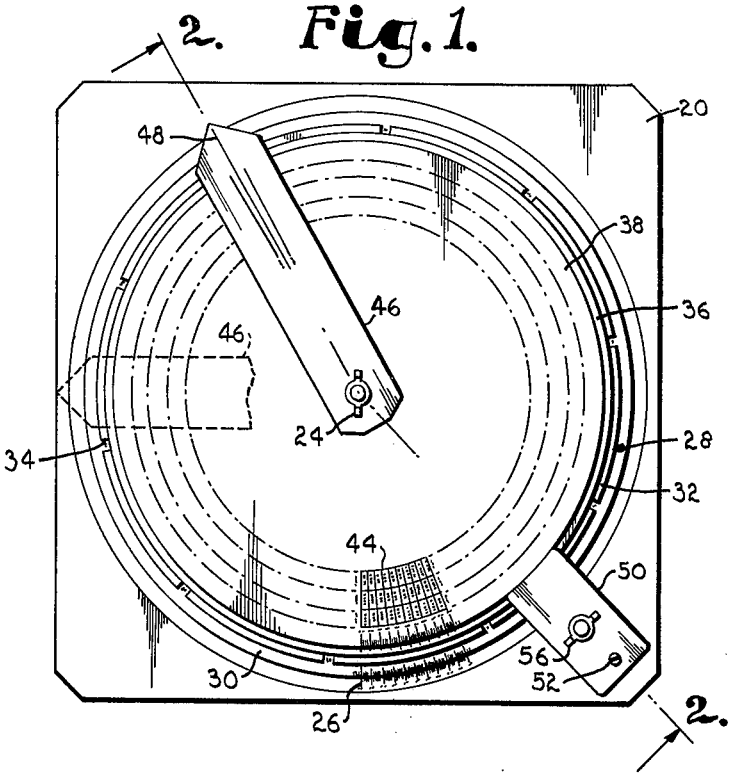
FIG. 1 is a top plan view of the calculating instrument of the present invention.
Figure 2:
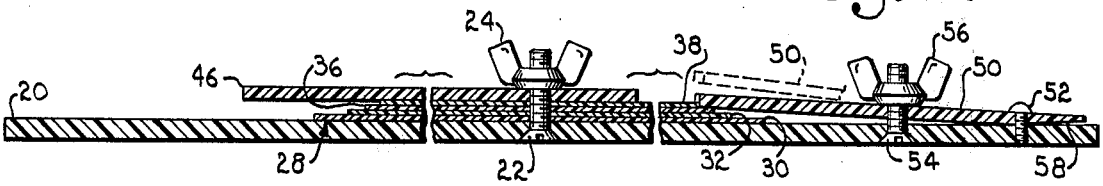
FIG. 2 is an enlarged, fragmentary, irregular cross-sectional view taken along line 2—2 of FIG. 1.

Referring initially to FIGS. 1, 2, 3 and 7, the calculating instrument of the present invention has a substantially square baseplate 20 of rigid material such as a suitable plastic. A pivot bolt 22 extends upwardly through the baseplate 20 at its center and is received by a wing nut 24. An annular rod reading scale 26 appears on the top face of the baseplate 20, and a rotatable, circular conversion unit 28 is held on the baseplate 20 by the pivot bolt 22 and wing nut 24. The conversion unit 28 is concentric with the annular rod reading scale 26, and the centers thereof are defined by the axis of the pivot bolt 22.

Figure 7:
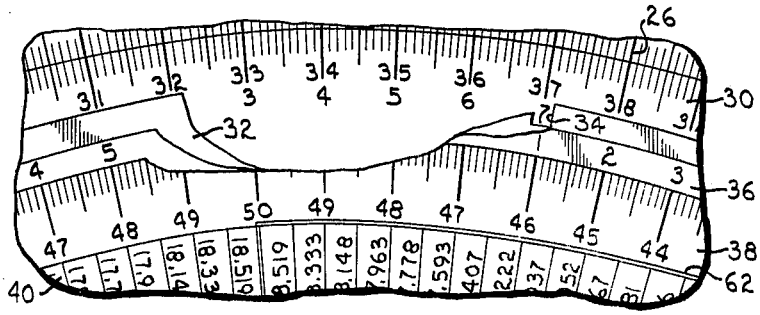
FIG. 7 is a greatly enlarged, fragmentary plan view with the margins of certain of the rotatable discs being broken away to reveal the hundreds elevation scale.

The conversion unit 28 includes three concentric discs superposed in step fashion. The bottom disc 30 has the greatest radius, but such radius is less than the mean radius of the rod reading scale 26 as will be apparent viewing FIG. 3 and from the following discussion. The margin of the bottom disc 30 has a units and tens elevation scale thereon and, as best illustrated in FIG. 7, a hundreds scale is radially spaced inwardly from the units and tens scale. In FIG. 7, the numerals 3, 4, 5, 6 and 7 of the hundreds scale are visible.

An intermediate disc 32 of the conversion unit 28 overlies the bottom disc 30 and is notched at its periphery to present a plurality of angularly spaced windows 34 through which the number 7 of the hundreds scale is visible. The third, uppermost disc 36 of the unit 28 has a repeating series of the numbers zero through 9 at its margin to represent the thousands digit of elevation.

A top disc member 38 overlies the thousands disc 36 of the unit 28 and is of slightly lesser radius. A depth scale is superimposed on the disc member 38 at its peripheral margin, and three concentric circular arrays of cut-and-fill quantity information appear on the disc member 38 radially inwardly spaced from the depth scale. Required cuts and fills are indicated by the depth scale, and the outermost circular array 40 contains material quantity information for cuts and fills made in a ground area 100 feet square (or 10 feet square). The numerical indicia in the center array 42 is quantity information based on a ground area 50 feet square, and the numerical indicia contained in the innermost array 44 is quantity information for cuts and fills in a ground area 25 feet square.

The various rotatable discs are preferably of metal construction and may have the scales and numerical information superimposed thereon by photographic processes, etching or other suitable means. The top disc member 38 is coaxial with the pivot bolt 22 and rotatable thereon, and a transparent pointer 46 overlies the entire disc assembly as is clear in FIGS. 1 and 2. A hairline 48 (see particularly FIGS. 4 and 5) is etched on the pointer 46 in exact radial alignment with the axis of the pivot bolt 22, and the pointer 46 is of sufficient length to permit the hairline 48 to be visually superimposed on all of the scales. It will also be noted that the words "fill" and "cut" appear on the pointer 46 on opposite sides of the hairline 48 for a purpose to be discussed hereinafter.

A locking device for the conversion unit 28 is disposed at the lower righthand corner of the base plate 20 as viewed in FIG. 1. Such device comprises a rigid plastic tab 50 secured to the baseplate 20 at its outer end by a screw 52. The tab 50 is transparent with its inner end located in overlying engagement with the peripheral margin of the thousands disc 36; the tab 50 does not engage the top disc member 38. A bolt 54 extends upwardly through the baseplate 20 and the central portion of the tab 50 and is received by a wing nut 56. The undersurface 58 at the outer end of the tab 50 is chamfered so that, when the tab is released by advancing the wing nut 56 upwardly on the bolt 54, the inner end of the tab elevates to release the discs of the conversion unit 28 for free rotation.

THE SCALES AND QUANTITY INDICIA

Figure 3:
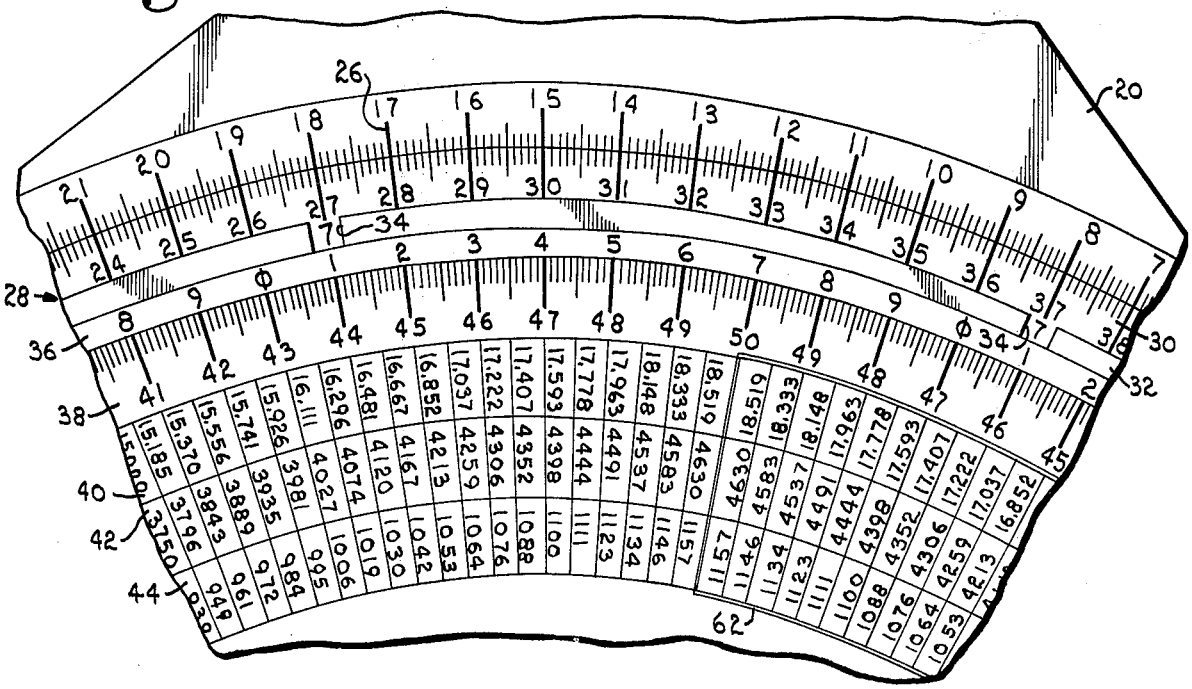
FIG. 3 is a greatly enlarged, partial plan view illustrating the use of the calculator in converting site rod readings to sea level elevations.
Figure 4:
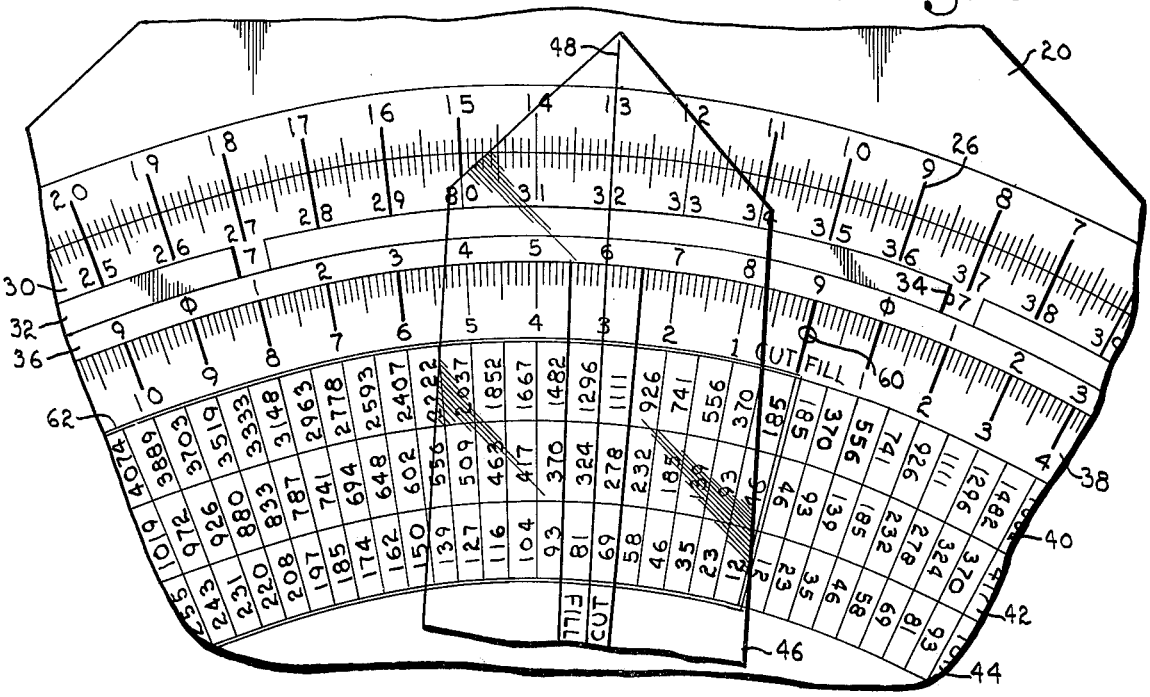
FIG. 4 is a view similar to FIG. 3 and illustrates use of the calculator in determining cut or fill staking markings from rod readings or from sea level readings.
Figure 5:
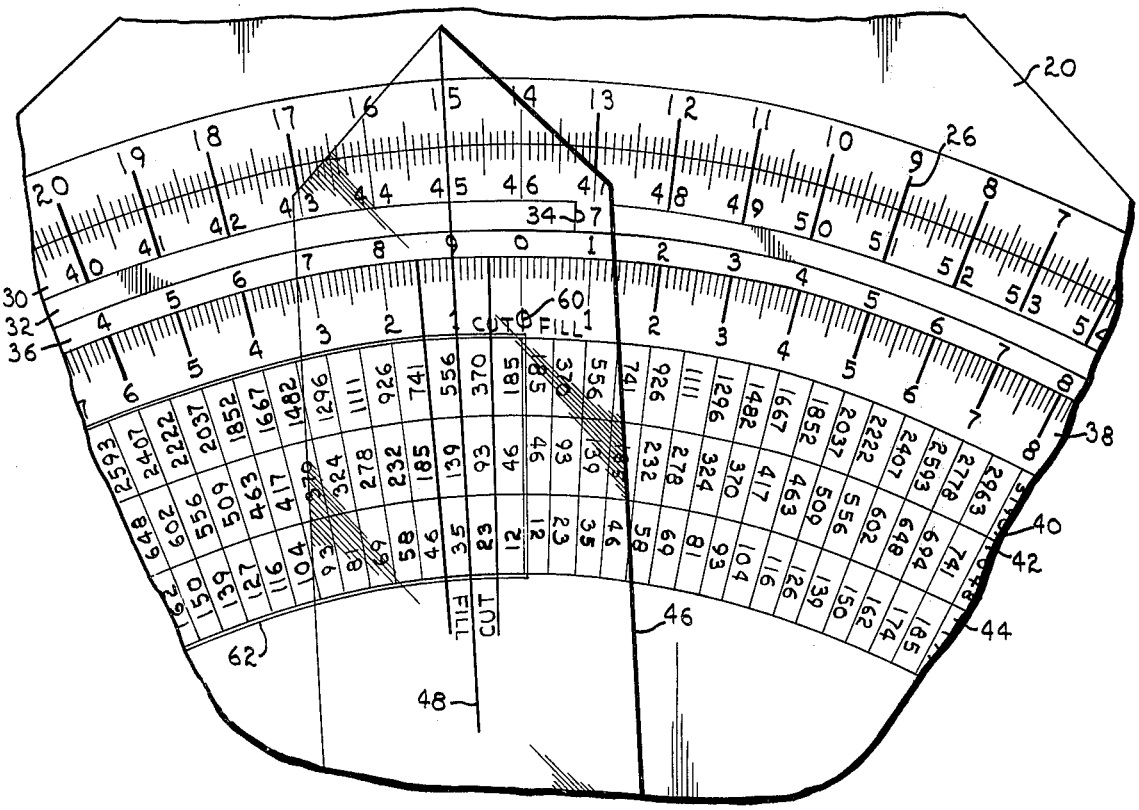
FIG. 5 is another view similar to FIG. 3, but with the scales rotated to illustrate a different problem situation where it is desired to determine cut or fill quantities from a site drawing having existing grades and desired finish grades indicated thereon.

The annular scales of the calculating instrument and the arrays of material quantity indicia are shown in detail fragmentarily in the drawings but sufficiently to permit a thorough understanding of the principles of the present invention. Referring first to the rod reading scale 26 on the baseplate 20, this annular scale may be viewed as a circle divided equally into 1,000 angular increments with numerals at each division of 10 increments from 0 through 99. In FIGS. 3–5, the numerals 7 through 20 may be seen. These numbers are to be read in feet, with each graduation corresponding to 0.1 foot. As evident from the drawings, the graduations are elongated at each foot and one-half foot. The readings on scale 26 are rod readings as seen through a surveyor's transit, and thus represent the distance read on the rod either above ground level or above the base of a bored hole.

The basic function of the conversion unit 28 is to directly convert rod readings to datum or sea level elevations. The units and tens elevation scale on the bottom disc component 30 is identical to the rod reading scale 26, except that the elevation scale is numbered inversely with respect to the numbering on the rod reading scale. In the units and tens elevation scale, the range of numerical values of elevation increase in a clockwise direction, whereas the corresponding values on the rod reading scale 26 increase in a counterclockwise direction. This inverse relationship of these two scales is due to the fact that rod readings on a surveyor's rod increase in an upward direction, thereby requiring a corresponding compensation when it is considered that the elevation to be determined is the elevation at the base of the rod (or bottom of a hole beneath the rod bored to a known depth). It should be noted that the graduations of these two scales are spaced at equal angular increments, thus they match except for the direction in which the numbers increase.

The hundreds scale is a series of numbers from 0 through 9 repeated 10 times around the circle for convenience. Accordingly, there are 10 windows 34 in the intermediate disc 32 angularly spaced at even intervals to reveal only one selected digit. In FIGS. 3 and 4, it may be seen that the hundreds digit 7 is revealed in two of the windows 34 there illustrated.

Likewise, the thousands scale on the disc 36 is a series of numbers from 0 through 9 repeated 10 times around the circle. In FIGS. 3–5, the digit 1 of the thousands scale is aligned with the 7 on the hundreds scale to represent 1,700 feet. Accordingly, the total elevation range of the instrument is from 0 through 9,999.9 feet, reading the units and tens elevation scale to the nearest graduation.

Now referring to the top disc member 38, the depth scale (depth of cuts and fills) is divided into 1,000 equal angular increments in the same manner as the rod reading scale 26 and the units and tens elevation scale that opposes it. However, the graduations indicate progressively increasing amounts in opposite directions away from a zero mark 60 seen in FIGS. 4 and 5. Thus, the depth scale is numbered from 0 to 50 (see FIG. 3) with depths of cut increasing in a counterclockwise direction away from zero mark 60, and depths of fill increasing in a clockwise direction away from zero mark 60. The legend "cut" and "fill" on opposite sides of zero mark 60 are provided for the guidance of the user.

The circular arrays 40, 42 and 44 of cut-and-fill quantity information are divided into 200 equal angular spaces, one space for each 0.5 foot of cut or fill as read on the depth scale at the margin of the disc member 38. The number in each space of the outermost circular array 40 is the cubic yard quantity (computed to the nearest cubic yard) contained within a 10,000 square foot area (100 foot square grid) when cut or filled to the depth indicated by the number adjacent that space on the depth scale. For example, referring to FIG. 4, the cubic yard quantity corresponding to a cut of 3 feet is 1,111 cubic yards on a 100 foot square grid (note that the cut information is on the right side of the hairline 48 as directed by the "cut" legend on the pointer 46). The quantity for a 100 square foot area (10 foot square grid) would be 11 cubic yards, the solution being obtained by dropping the last two digits of the number shown for the 100 foot grid.

Again with reference to FIG. 4, the intermediate array 42 gives quantities in cubic yards for a 2,500 square foot area (50 foot square grid) and the innermost array 44 gives quantity information for a 625 square foot area (25 foot square grid). Accordingly, a 3-foot cut for a 50-foot grid represents a quantity of material equal to 278 cubic yards, or 69 cubic yards for a 25 foot grid. For clarity, the cut quantity information covering 180° of the circular arrays may be enclosed in a border such as illustrated at 62, preferably red in color if black numbers are used on a white background.

OPERATION

Figure 6:
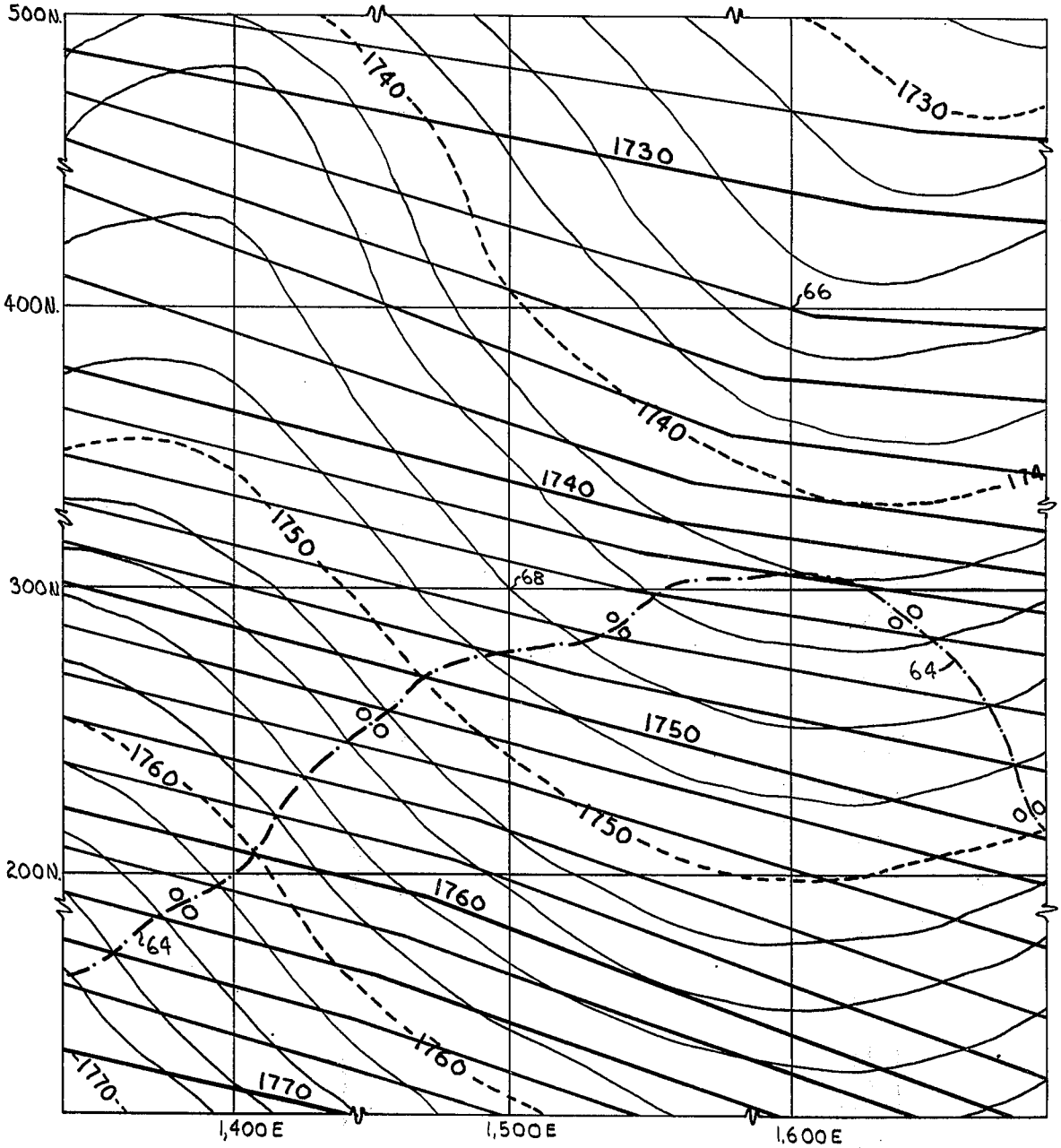
FIG. 6 shows a portion of a representative site drawing.

The operation and manner of use of the calculating instrument of the present invention will be illustrated by setting forth four problem examples and their solutions. FIG. 6 is a representative site drawing that will be used in connection with the problems. Existing grades in the site drawing are shown by broken contour lines at intervals of 10 feet; solid contour lines at 2-foot increments of elevation are between the broken contour lines. The heavier solid lines are finish grades at 2-foot intervals. The broken line 64 is a 0—0 line along which the existing and finish grades are the same elevation. The area beneath the 0—0 line 64 must be filled in order to bring the elevations up to the finish grade; conversely, the area above the 0—0 line 64 must be excavated in order to obtain the finish grades.

The site plan of FIG. 6 has gridded into squares 100 feet on a side. As is customary, the grid lines are designated by abscissa and ordinate values from an established origin (a selected landmark adjacent the site). Accordingly, the grid intersections are designated by coordinates east and north of such origin as indicated by 1,400 E, 1,500 E, and 1,600 E along the bottom of the drawing, and 200 N, 300 N, 400 N, and 500 N along the left side of the drawing.

The first problem to be discussed is that of converting site rod readings to datum or mean sea level elevations. (A datum elevation is recorded elevation such as marked by a monument in a geodetic survey.) If a datum elevation is not available at the site, then a bench mark elevation is brought to the site from a datum elevation in accordance with usual surveying practice. It will be assumed for purposes of illustration that the bench mark rod reading is 10 and that such reading corresponds to an elevation of 1,735 feet above sea level.

Referring to FIG. 3, it may be seen that the bench mark rod reading has been matched with the last two digits of the sea level elevation. The numeral 10 of the baseplate rod reading scale 26 is aligned with the number 35 on the bottom disc 30 of the conversion unit 28. The intermediate disc 32 is positioned so that its windows 34 reveal the number 7, and the thousands disc 36 is rotated to align the number 1 with the corresponding 7 now revealed through the associated window 34. Accordingly, by rotating the three discs of the conversion unit 28 to the operational setting illustrated, the operator is now able to directly convert rod readings to sea level elevations. The wing nut 56 of the locking device is turned in a direction to force the tab 50 against the edge of disc 36 to lock the conversion unit 28 in the setting illustrated.

Through the use of the instrument of the present invention, the site drawing with existing grades indicated may be readily prepared from the rod readings taken in the field survey. Sea level elevations may be quickly read to the nearest 1/10 foot, and the conversion to sea level may be made and recorded in the field if desired. For example, a rod reading of 14.2 feet is quickly read as 1,730.8 feet above sea level.

The second problem example is the determination of cut-or-fill staking markings from rod readings or from sea level readings. Again, the instrument is set to relate rod readings to the bench mark elevation. Referring to FIG. 4, the setting of the conversion unit 28 is the same as discussed above for FIG. 3. It is assumed that, referring to FIG. 6, it is desired to determine the staking marking for the upper righthand grid intersection 66 (coordinates 1,600 E, 400 N). The rod reading at the intersection is 10 (by coincidence, the bench mark elevation) and the site drawings indicate that the finish grade is 1,732 feet. The zero mark 60 of the depth scale on the top disc member 38 is rotated to a position in radial alignment with the rod reading (10); alignment may be facilitated by using the hairline 48 on the pointer 46. Then, the pointer is moved to align the hairline 48 with the finish grade, the last two digits thereof being 32. Now reading the depth scale, it may be seen that the stake at this grid intersection should be marked for a cut of 3 feet. It should be noted that in this illustration it was unnecessary to convert the rod reading to the existing elevation as this was automatically done by the conversion unit 28. Alternatively, of course, the zero mark 60 may be aligned with the existing grade as read from the site drawing. If a quantity takeoff is desired, this can be directly read as 1,111 cubic yards.

The third problem illustration is specifically with respect to the determination of material quantities to be moved. Preferably, the conversion unit 28 is set so that sea level readings are in the range of the instrument. This can be done by aligning the highest indicated sea level reading shown on the site drawing with rod reading number 10. The locking tab wing nut 56 is tightened to retain the setting. Referring to FIG. 5, for the purposes of this problem illustration the elevation 1,750 has been aligned with rod reading 10 since the elevations to be dealt with are within the range shown by the FIG. 5 setting. It is assumed that it is desired to determine, from the site drawing of FIG. 6, the quantity of material that will be excavated in an area 100 feet square centered on grid intersection 68 (coordinates 1,500 E, 300 N). The existing grade elevation at this intersection is read as exactly 1,746 feet, and the finish grade is read as 1,745 feet. The zero mark 60 is radially aligned with 46 on the bottom disc 30, and the pointer 46 is rotated to superimpose the hairline 48 on the number 45 of the elevation scale. The quantity (cut) is then obtained from the outermost circular array 40 and is read as 370 cubic yards. To determine the net quantity for import to or removal from the site, this calculation is repeated for each of the grid intersections and the total (cut or fill) is thereby derived.

The foregoing example is a simple illustration of quantity determination. In this case, it is subject to inaccuracy due to the presence of the 0—0 line 64, since a portion of the area within the 100 foot square (centered on intersection 68) would be below the 0—0 line 64 and thus a small fill would be required. This is contemplated in the present invention by the provision of the circular arrays 42 and 44 for 50 and 25-foot grids respectively. The 50-foot grid would be used for moderately rough sites, and the 25-foot grid (or even the 10-foot grid) would be used for steep slopes. Accordingly, at sudden changes in contour or transition such as represented by the 0—0 line 64, a finer grid would be employed so that the quantity approximations are more accurate.

The fourth problem situation illustrates use of the instrument in reverse conversion, i.e., the direct conversion of elevations into rod readings. This type of conversion is needed, for example, in order to set "blue top" stakes for fine finish grading. Here the conversion unit 28 is locked as in the previous examples to relate the bench mark rod reading to the corresponding sea level elevation. The required locations of grade staking to obtain adequate control of grading are determined, and these locations are found on the site drawing. Then, from the drawing, the finish grade at each stake location is read and that elevation is viewed on the units and tens elevation scale appearing on the bottom disc 30. The radially aligned reading on the baseplate rod reading scale 26 will now be the required rod reading for the top of the stake (finish grade to be made flush with the top of the stake).

Having thus described the invention, what is claimed as new and desired to be secured by Letters Patent is:

1. A rotary topographic calculator comprising:

a baseplate having an annular scale graduated to indicate a range of rod readings;

a conversion unit mounted on said baseplate and operable to directly convert rod readings on said scale into corresponding elevations relative to a predetermined reference elevation, said unit including a rotatable disc component coaxial with said scale, and an annular elevation scale concentrically arranged on said disc component and graduated to cover a range of numerical values corresponding to said range of rod readings, like angular increments between the graduations of said rod reading and elevation scales being equal to the same distance on both scales, said elevation scale being numbered inversely with respect to said rod reading scale, and said disc component being rotatable to an operational setting radially aligning a predetermined rod reading with the numerical value on said elevation scale corresponding to a known elevation, whereby other rod readings may be directly converted into corresponding elevations by reading the aligned numerical values on the elevation scale or, conversely, elevations may be converted into rod readings;

a rotatable disc member carried by said baseplate and coaxial with said disc component; and an annular depth scale concentrically arranged on said disc member and graduated to indicate depth of cut and depth of fill in progressively increasing amounts in opposite directions away from a zero mark, the angular increments between the graduations of said depth scale being equal to the same units of measurement as like angular increments on said rod reading and elevation scales, said disc member being rotatable to a position radially aligning said zero mark with a selected rod reading or elevation, whereby the depth scale then indicates the cut or fill at other corresponding radially aligned elevations.

2. The calculator as claimed in claim 1, further comprising a locking device on said baseplate engagable with said disc component for holding the latter at said operational setting while permitting free rotation of said disc member.

3. The calculator as claimed in claim 1, wherein said annular rod reading, elevation, and depth scales have different radii, and wherein a radial indicating pointer is provided rotatable about the common axis of said disc component and disc member and extending to the scale of greatest radius.

4. The calculator as claimed in claim 3, further comprising cut and fill quantity indicia on said disc member arranged in a circular array in substantial radial alignment with corresponding graduations of said depth scale, and based on a predetermined area of ground when cut or filled to the depth indicated by said depth scale.

5. A rotary topographic calculator comprising:

a baseplate having an annular scale for indicating rod readings; and a rotatable conversion unit mounted on said baseplate and operable to directly convert rod readings on said scale into corresponding elevations relative to a predetermined reference elevation, said unit being provided with three annular elevation scales of different radii within said rod reading scale and concentric therewith, and including three independently rotatable discs coaxial with said scales for aligning said elevation scales in a selected orientation to indicate elevation relative to said predetermined reference elevation, one of said elevation scales covering a range of numerical values formed by the units and tens digits of elevation, a second of said elevation scales representing the hundreds digit of elevation, and the third elevation scale representing the thousands digit of elevation, said one elevation scale being concentrically arranged on one of said discs and numbered inversely with respect to said rod reading scale, and said one disc being rotatable to an operational setting radially aligning a predetermined rod reading with the numerical value on said one scale corresponding to a known elevation, whereby other rod readings may be directly converted into corresponding elevations by reading the aligned numerical values on said one elevation scale in conjunction with the digits of said known elevation read from said second and third scales or, conversely, elevations may be converted into rod readings, said second elevation scale being concentrically arranged on said one disc within said one elevation scale, a second of said discs overlying said second scale and having a window therein for revealing a selected hundreds digit.

6. A rotary topographic calculator comprising:

a baseplate having an annular scale for indicating rod readings;

a rotatable conversion unit mounted on said baseplate and operable to directly convert rod readings on said scale into corresponding elevations relative to a predetermined reference elevation, said unit being provided with three annular elevation scales of different radii within said rod reading scale and concentric therewith, and including three independently rotatable discs coaxial with said scales for aligning said elevation scales in a selected orientation to indicate elevation relative to said predetermined reference elevation, one of said elevation scales covering a range of numerical values formed by the units and tens digits of elevation, a second of said elevation scales representing the hundreds digit of elevation, and the third elevation scale representing the thousands digit of elevation, said one elevation scale being concentrically arranged on one of said discs and numbered inversely with respect to said rod reading scale, and said one disc being rotatable to an operational setting radially aligning a predetermined rod reading with the numerical value on said one scale corresponding to a known elevation, whereby other rod readings may be directly converted into corresponding elevations by reading the aligned numerical values on said one elevation scale in conjunction with the digits of said known elevation read from said second and third scales or, conversely, elevations may be converted into rod readings;

a rotatable disc member carried by said baseplate and coaxial with said three discs; and an annular depth scale concentrically arranged on said disc member and graduated to indicate depth of cut and depth of fill in progressively increasing amounts in opposite directions away from a zero mark, said disc member being rotatable to a position radially aligning said zero mark with a selected rod reading or numerical value of elevation on said one elevation scale, whereby the depth scale then indicates the cut or fill at other corresponding radially aligned elevations on said one elevation scale.

7. The calculator as claimed in claim 6, wherein said annular depth scale is circumscribed by said three elevation scales, and wherein a radial indicating pointer is provided rotatable about the common axis of said three discs and said disc member and extending to said rod reading scale.

8. The calculator as claimed in claim 7, further comprising cut and fill quantity indicia on said disc member within said depth scale and arranged in a circular array in substantial radial alignment with corresponding graduations of said depth scale, and based on a predetermined area of ground when cut or filled to the depth indicated by said depth scale.

9. A rotary topographic calculator comprising:

three superposed plate elements mounted for relative rotation about a predetermined axis;

an annular scale arranged on one of said elements in concentric relationship with said axis and graduated to indicate a range of rod readings;

an annular elevation scale arranged on a second of said elements in concentric relationship with said axis and graduated to cover a range of numerical values corresponding to said range of rod readings, and being numbered inversely with respect to said rod reading scale; and an annular depth scale arranged on the third of said elements in concentric relationship with said axis and graduated to indicate depth of cut and depth of fill in progressively increasing amounts in opposite directions away from a zero mark, the angular increments between the graduations of said depth scale being equal to the same units of measurement as like angular increments on said rod reading and elevation scales, said one and second elements being relatively rotatable to an operational setting radially aligning a predetermined rod reading with the numerical value on said elevation scale corresponding to a known elevation, said one, second and third elements being relatively rotatable to a position radially aligning said zero mark with a selected rod reading or elevation, whereby the depth scale then indicates the cut or fill at other corresponding radially aligned elevations.

10. The calculator as claimed in claim 9, wherein said annular rod reading, elevation, and depth scales have different radii, and wherein a radial indicating pointer is provided rotatable about said axis and extending to the scale of greatest radius.

11. The calculator as claimed in claim 9, further comprising cut and fill quantity indicia on said third element arranged in a circular array in substantial radial alignment with corresponding graduations of said depth scale, and based on a predetermined area of ground when cut or filled to the depth indicated by said depth scale.

* * * * *